US005118570A

United States Patent [19]

Malhotra

[11] Patent Number: 5,118,570

[45] Date of Patent: * Jun. 2, 1992

[54] INK JET TRANSPARENCIES AND PAPERS

[75] Inventor: Shadi L. Malhotra, Mississauga, Canada

[73] Assignee: Xerox Corporation, Stamford, Conn.

[ * ] Notice: The portion of the term of this patent subsequent to Sep. 12, 2006 has been disclaimed.

[21] Appl. No.: 640,795

[22] Filed: Jan. 14, 1991

Related U.S. Application Data

[62] Division of Ser. No. 307,451, Feb. 8, 1989, Pat. No. 5,006,407.

[51] Int. Cl.[5] ..... B41M 5/00

[52] U.S. Cl. ..... 428/474.4; 346/135.1; 428/195; 428/331; 428/500; 428/532

[58] Field of Search ..... 428/195, 419, 480, 481, 428/483, 500, 508, 509, 523, 532, 331, 474.4; 346/135.1

[56] References Cited

U.S. PATENT DOCUMENTS

| | | | |
|---|---|---|---|
| 4,474,850 | 10/1984 | Burwasser | 428/336 |
| 4,503,111 | 3/1985 | Jaeger et al. | 428/195 |
| 4,547,405 | 10/1985 | Bedell et al. | 427/256 |
| 4,555,437 | 11/1985 | Tanck | 428/212 |
| 4,578,285 | 3/1986 | Viola | 427/209 |
| 4,592,954 | 6/1986 | Malhotra | 428/335 |
| 4,680,235 | 7/1987 | Murakami et al. | 428/195 |
| 4,865,914 | 9/1989 | Malhotra | 428/195 |
| 5,006,407 | 4/1991 | Malhotra | 428/195 |

FOREIGN PATENT DOCUMENTS

| | | | |
|---|---|---|---|
| 1032787 | 2/1986 | Japan | 428/195 |

*Primary Examiner*—Pamela R. Schwartz
*Attorney, Agent, or Firm*—E. O. Palazzo

[57] ABSTRACT

A transparency comprised of a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

13 Claims, No Drawings

INK JET TRANSPARENCIES AND PAPERS

This is a division of application Ser. No. 307,451, filed Feb. 8, 1989 now U.S. Pat. No. 5,006,407.

BACKGROUND OF THE INVENTION

This invention relates generally to transparencies, and more specifically the present invention is directed to humidity resistant transparencies comprised of coatings with additives, and the use of these transparencies in ink jet printing processes. In one embodiment, the present invention relates to transparencies comprised of a supporting substrate with certain coatings thereover containing small molecules such as plasticizers and optional fillers as illustrated herein, which transparencies are particularly useful in ink jet printing processes. Additionally, in another embodiment of the present invention there are provided papers for ink jet printing, which papers contain thereover coatings containing small molecules such as plasticizers as illustrated herein with, for example, colloidal silica dispersed therein in, for example, an effective amount, such as from about 30 to about 75 percent by weight. Additionally, in another embodiment of the present invention there are provided plastic papers for ink jet printing, which papers contain thereover coatings containing small molecules such as plasticizers as illustrated herein with, for example, metal oxides such as titanium dioxide dispersed therein, for example, in an effective amount such as from about 10 to about 45 percent by weight. The coated paper substrates of the present invention may also be incorporated into electrostatographic imaging processes.

Ink jet printing systems are well known. Thus, for example, there is described in U.S. Pat. No. 3,846,141 a composition for ink jet printing comprised of an aqueous solution of a water soluble dye and a humectant material formed of a mixture of a lower alkoxy triglycol, and at least one other compound selected from the group consisting of a polyethylene glycol, a lower alkyl ether of diethylene glycol, and glycerol. According to the disclosure of this patent, the viscosity of the printing inks is subjected to little variation with use in that water is lost by evaporation during recirculation of the ink composition through the ink jet printer. Moreover, apparently the humectant system disclosed in this patent substantially prevents or minimizes tip drying of the printing ink in the orifice or nozzle during down time of the printer such as when the printer is rendered inoperative. As further disclosed in the patent, the basic imaging technique in jet printing involves the use of one or more ink jet assemblies connected to a pressurized source of ink. Each individual ink jet includes a very small orifice usually of a diameter of 0.0024 inch, which is energized by magneto restrictive piezoelectric means for the purpose of emitting a continuous stream of uniform droplets of ink at a rate of 33 to 75 kilohertz. This stream of droplets is desirably directed onto the surface of a moving web of, for example, paper and is controlled to form printed characters in response to video signals derived from an electronic character generator and in response to an electrostatic deflection system. The disclosure of the '141 patent, especially with regard to the ink jet printing process, is totally incorporated herein by reference.

Also, there are disclosed in U.S. Pat. No. 4,279,653 ink jet compositions containing water soluble wetting agents, a water soluble dye and an oxygen absorber.

Similarly, U.S. Pat. No. 4,196,007 describes an ink jet printing composition containing an aqueous solution of water soluble dye and a humectant consisting of at least one water soluble unsaturated compound. Other documents disclosing aqueous inks for ink jet printing include U.S. Pat. Nos. 4,101,329; 4,290,072 and 4,299,630.

Ink jet recording methods and ink jet transparencies using the above-mentioned or similar inks are well known. There is disclosed in U.S. Pat. No. 4,446,174 an ink jet recording method for producing a recorded image on an image receiving sheet with aqueous inks, and wherein an ink jet is projected onto an image receiving sheet comprising a surface layer containing a pigment, which surface layer is capable of adsorbing a coloring component present in the aqueous ink. Also, there is disclosed in U.S. Pat. No. 4,371,582 an ink jet recording sheet containing a latex polymer, which can provide images having excellent water resistance properties and high image density by jetting them onto an aqueous ink containing a water soluble dye. Similarly, U.S. Pat. No. 4,547,405 describes an ink jet recording sheet comprising a transparent support with a layer comprising 5 to 100 percent by weight of a coalesced block copolymer latex of poly(vinyl alcohol) with polyvinyl(benzyl ammonium chloride), and 0 to 95 percent by weight of a water soluble polymer selected from the group consisting of poly(vinyl alcohol), poly(vinyl pyrrolidone), and copolymers thereof. In the '405 patent there is also disclosed an ink jet recording sheet comprising a layer which includes poly(vinyl pyrrolidone). A support is also disclosed in the '405 patent, which support may include polycarbonates, see column 4, line 62, for example. The disclosures of each of the aforementioned patents are totally incorporated herein by reference.

In U.S. Pat. No. 4,680,235 there is disclosed an ink jet recording material with image stabilizing agents, see column 4, lines 32 to 58, for example. Also, in column 4, line 57, for example, this patent discloses the use of a plasticizer in a surface recording layer.

In addition to the aforesaid '405 and '235 patents there were located as a result of a patentability search U.S. Pat. No. 4,555,437, which discloses an ink jet transparency with a sulfurous acid salt component which enhances the image bleed resistance of the transparency, reference for example column 3, lines 1 to 9; and 4,578,285, which discloses a water based transparency coating typically comprised of polyurethane and a polymer such as polyvinylpyrrolidone, PVP/vinyl acetate copolymer, polyethylene oxide, gelatin, or polyacrylic acid.

Further, in U.S. Pat. No. 4,701,837 there is disclosed a light transmissive medium having a crosslinked-polymer ink receiving layer; and U.S. Pat. No. 4,775,594 describes an ink jet transparency with improved wetting properties.

Other coatings for ink jet transparencies include blends of carboxylated polymers with poly(alkylene glycol), reference U.S. Pat. No. 4,474,850; blends of poly(vinyl pyrrolidone) with matrix forming polymers such as gelatin; or poly(vinyl alcohol), swellable by water and insoluble at room temperature but soluble at elevated temperatures, reference U.S. Pat. No. 4,503,111; and blends of poly(ethylene oxide) with carboxymethyl cellulose as illustrated in U.S. Pat. No. 4,592,954, mentioned herein, the disclosure of each of the aforementioned patents being totally incorporated herein by reference.

Further, in U.S. Pat. No. 4,592,954, mentioned herein, the disclosure of which is totally incorporated herein by reference, there is illustrated a transparency for ink jet printing comprised of a supporting substrate and thereover a coating consisting essentially of a blend of carboxymethyl cellulose, and polyethylene oxides. Also, in this patent there is illustrated a transparency wherein the coating is comprised of a blend of hydroxy propyl methyl cellulose and poly(ethylene glycol monomethyl ether), a blend of carboxy methyl cellulose and poly(vinyl alcohol), or a blend of hydroxyethyl cellulose and vinyl pyrrolidone/diethylamino methylmethacrylate copolymer. One disadvantage associated with the transparencies of U.S. Pat. No. 4,592,954 is their insufficient resistance to relative humidities of, for example, exceeding 50 percent at 80° F. which leads to the onset of blooming and bleeding of colors in the printed text or graphics only in four to six hours. These and other disadvantages are avoided with the transparencies of the present invention.

In U.S. Pat. No. 4,865,914, the disclosure of which is totally incorporated herein by reference, there are illustrated ink jet transparencies and ink jet papers with coatings thereover which are compatible with the inks selected for marking, and wherein the coatings enable acceptable optical density images to be obtained. More specifically, in one embodiment of the aforesaid application there are provided ink jet transparencies comprised of a supporting substrate, and a coating thereover comprised of a ternary mixture of hydroxypropyl cellulose, carboxymethyl cellulose, and poly(ethylene oxide). Moreover, in another embodiment disclosed in the patent there are provided coatings for ink jet paper comprised of a supporting substrate, and thereover a quaternary mixture of hydroxy propyl cellulose, carboxymethyl cellulose, poly(ethylene oxide), and colloidal silica.

A specific embodiment of U.S. Pat. No. 4,865,914 is directed to a transparency comprised of a supporting substrate, and thereover a blend comprises of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl) propane sulfonic acid; (8) poly(vinyl alcohol); (9) poly(vinyl pyrrolidone); and (10) hydroxypropyl methyl cellulose. Additionally, there is illustrated in the aforesaid patent ink jet papers comprised of a supporting substrate, and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl) propane sulfonic acid; (8) poly(vinyl alcohol); (9) poly(vinyl pyrrolidone); and (10) hydroxypropyl methyl cellulose, which coating has dispersed therein additives such as colloidal silicas in an amount of from about 35 to about 65 percent by weight.

Although the transparencies illustrated in the above prior art patents are suitable for their intended purposes, there remains a need for other transparencies with new coatings thereover that are useful in ink jet printing processes, and that will enable the formulation of images with high optical densities. Additionally, there is a need for transparencies with a blend of coatings thereover that are compatible with ink jet compositions, particularly those derivable from ethylene glycol/water components, which coatings contain therein plasticizers. There is also a need for coated papers that are useful in electrostatographic imaging processes wherein images with excellent resolution and no background deposits are obtained. Another need of the present invention resides in providing transparencies with a blend of coatings that do not block (stick) at, for example, 80 percent relative humidity and at a temperature of 80° F.

SUMMARY OF THE INVENTION

It is an object of the present invention to provide transparencies with many of the advantages indicated herein.

Another object of the present invention resides in the provision of humidity resistant ink jet transparencies with certain coatings thereover containing plasticizers and optional fillers therein.

Also, in another object of the present invention there are provided humidity resistant transparencies with hydrophilic coatings thereover containing plasticizers and fillers therein thus enabling images with high optical densities.

Also, in another object of the present invention there are provided humidity resistant transparencies with certain coatings thereover containing plasticizers and fillers, which coatings accept low surface tension inks without cracking.

Another object of the present invention resides in ink jet transparencies that permit the substantial elimination of beading caused by poor inter-drop coalescence during mixing of the primary colors to generate secondary colors such as, for example, mixtures of cyan and yellow enabling green colors.

Furthermore, in another object of the present invention there are provided humidity resistant ink jet transparencies that enable elimination of bleeding of colors due to intermingling or diffusion of dyes when different colors, for example black, are suitably printed together with another color like magenta.

Moreover, another object of the present invention resides in ink jet transparencies that have substantial permanence for extended time periods.

Additionally, another object of the present invention relates to ink jet transparencies with a coating comprised of three or more components thereover.

Another object of the present invention relates to transparencies with specific coatings which enable water and glycol absorption from the inks selected in a rapid manner thereby enabling such coatings to be particularly useful in known ink jet printers.

In yet another object of the present invention there are provided coatings which are compatible with filled papers, sized papers and opaque Mylars, and which coatings will enable the aforementioned substrates to generate high optical density images with ink jet processes.

In still another object of the present invention there are provided polymer coatings for other substrates including paper products, such as those illustrated in the copending applications mentioned herein, which coatings enable an increase in the shelf life of the resulting products permitting their usefulness in various printers subsequent to extended storage, for example, in excess of six months in unsealed envelopes.

Moreover, in another object of the present invention there are provided humidity resistant transparencies with acceptable drying times, excellent spreading characteristics enabling, for example, printing speeds of from about 20 to about 30 pages per minute and a substantially zero dielectric value in some instances thus preventing the transparencies from jamming the machine system within which they are employed; and dust and fingerprint resistance.

These and other objects of the present invention are accomplished by providing transparencies and papers with coatings thereover. More specifically, in accordance with one embodiment of the present invention there are provided humidity resistant ink jet transparencies and ink jet papers with coatings thereover which are compatible with the inks selected for marking, and wherein the coatings enable, for example, acceptable optical density images to be obtained. Also provided in accordance with the present invention is a transparency comprised of a hydrophilic coating or coating blends and a plasticizer; and a transparency comprised of a supporting substrate, and a hydrophilic coating, or coating blends containing a plasticizer, which coating or blends thereof may contain a filler component.

In one specific embodiment of the present invention there are provided humidity resistant ink jet transparencies comprised of a supporting substrate, and a coating thereover comprised of a ternary mixture of hydroxypropyl cellulose, carboxymethyl cellulose, and poly(ethylene oxide), which coating contains a plasticizer and a filler component. Moreover, in another specific embodiment of the present invention there are provided ink jet papers comprised of a supporting substrate, and thereover a quaternary mixture of hydroxy propyl cellulose, carboxymethyl cellulose, poly(ethylene oxide), and colloidal silica, which coating contains therein a plasticizer. Furthermore, in another specific embodiment of the present invention there are provided coatings, or a coating for plastic ink jet papers comprised of a supporting substrate, and thereover a quaternary mixture of hydroxypropyl cellulose carboxymethyl cellulose, poly(ethylene oxide) and a metal oxide, such as titanium dioxide, which coating contains therein a plasticizer. Optional fillers and other similar components can be included in the aforementioned coatings.

Another specific embodiment of the present invention is directed to a humidity resistant transparency comprised of a supporting substrate, and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid; (8) poly(vinyl alcohol); (9) poly(vinyl pyrrolidone); and (10) hydroxypropyl methyl cellulose which blend contains therein a plasticizer together with a preferred effective amount of colloidal silica, such as from about 1 to about 5 percent by weight. Additionally, the present invention is directed to ink jet papers comprised of a suitable supporting substrate, and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid; (8) poly(vinyl alcohol); (9) poly(vinyl pyrrolidone); and (10) hydroxypropyl methyl cellulose, which coating has dispersed therein additives such as colloidal silicas in an amount of from about 30 to about 75 percent by weight, and wherein the blend contains therein a plasticizer. Additionally, the present invention is directed to plastic ink jet papers comprised of a supporting substrate, and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid; (8) poly(vinyl alcohol); (9) poly(vinyl pyrrolidone); and (10) hydroxypropyl methyl cellulose, which coating has dispersed therein additives including metal oxides such as titanium dioxide in an amount of from about 10 to about 45 percent by weight, and wherein the blend contains therein a plasticizer. Further, the hydrophilic coating of the present invention may be comprised of cellulose sulfate, methyl cellulose, hydroxyethyl cellulose, carboxymethyl cellulose, carboxymethyl hydroxyethyl cellulose, hydroxyethylmethyl cellulose, poly (acrylamide), ethylmethyl cellulose, ethyl cellulose, cyanoethyl cellulose, ethylhydroxyethyl cellulose, hydroxypropyl cellulose, acrylamide/acrylic acid copolymers, which coating contains plasticizers and fillers, or a plasticizer or a filler.

Specifically, the hydrophilic coatings of the present invention may be comprised of various blends including, for example, those comprised of carboxymethyl cellulose of from about 95 to about 30 percent by weight and poly(acrylamide) of from about 2 to about 45 percent by weight; blends of carboxymethyl cellulose of from about 95 to about 30 by weight and poly(ethylene oxide) of from about 2 to about 45 percent by weight; blends of methyl cellulose of from about 95 to about 30 percent by weight and poly(acrylamide) of from about 2 to about 45 percent by weight; blends of hydroxyethyl cellulose of from about 95 to about 30 percent by weight and poly(ethylene oxide) of from about 2 to about 45 percent by weight; blends of hydroxypropylmethyl cellulose of from about 95 to about 30 percent by weight and poly(ethylene oxide) of from about 2 to about 45 percent by weight, which coatings contain therein plasticizers and fillers, or a plasticizer or a filler. Other blend amounts may be selected providing the objectives of the present invention are achievable.

Examples of plasticizers present, for example, in effective amounts to enable humidity resistance, such as for example from about 2 to about 20 percent, include glycols such as ethylene glycol, diethylene glycol, propylene glycol; glycerols; substituted glycerols such as glycerol monomethyl ether, glycerol monochlorohydrin, alkylene carbonates such as ethylene carbonate, propylene carbonate; substituted phthalic anhydrides such as tetrachloro phthalic anhydride, tetra bromo phthalic anhydride; phosphates such as urea phosphate, triphenyl phosphate; stearic acid derivatives such as glycerol monostearate, propylene glycol monostearate; sulfolanes such as tetramethylene sulfone; pyrrolidones such as n-methyl-2-pyrrolidinone and n-vinyl-2-pyrrolidinone; other known effective plastizers; mixtures thereof; and the like providing the objectives of the present invention are achieved. Examples of fillers present, for example, in effective amounts to enable humidity resistance such as, for example, from about 1 to about 5 percent by weight, although other amounts may be used providing the objectives of the present invention are achieved, include silicates such as colloidal silica; metal oxides such as titanium dioxide; carbonates such as calcium carbonate; sulfates such as barium sulfate; insoluble cellulose materials such as α-cellulose; other known effective fillers; mixtures thereof; and the like providing the objectives of the present invention are achieved.

Illustrative examples of substrates usually, for example, with a thickness of from about 50 microns to about 125 microns, and preferably of a thickness of from about 100 microns to about 125 microns that may be selected for the ink jet transparencies include Mylar, commercially available from E. I. DuPont; Melinex, commercially available from Imperials Chemical, Inc.; Celanar, commercially available from Celanese; polycarbonates, especially Lexan; polysulfones; cellulose triacetate; polyvinylchlorides; and the like, such as those illustrated in U.S. Pat. No. 4,865,914, the disclosure of which is totally incorporated herein by reference, with Mylar being particularly preferred in view of its availability and lower costs.

Specific coatings that may be selected for the ink jet transparency substrates or for the ink jet papers are as illustrated herein and include carboxymethyl cellulose, carboxymethyl hydroxyethyl cellulose, hydroxypropyl methyl cellulose, poly(acrylamide), or mixtures thereof, which coatings contain therein plasticizers such as glycols, glycerols, pyrrolidinones, propylene carbonates, ethylene carbonates, other alkyl carbonates, sulfolanes, and fillers such as silica, titanium dixoide and the like; blends of (1) poly(ethylene oxide), hydroxypropyl cellulose, and carboxymethyl cellulose; (2) poly(ethylene oxide), hydroxyethyl cellulose, and carboxymethyl cellulose; (3) poly(ethylene oxide) with vinylmethyl ether/maleic acid copolymer and hydroxypropyl cellulose; (4) hydroxypropyl methyl cellulose, carboxymethyl cellulose, and polyethylene oxide with plasticizers and fillers, or a plasticizer or a filler therein. Particularly preferred are blends of hydroxypropyl methyl cellulose, carboxymethyl cellulose and poly(ethylene oxide); and the other blends illustrated herein with plasticizers and fillers therein, or a plasticizer or a filler therein. The aforementioned blends are selected in various effective percentages depending, for example, on the composition of the supporting substrate. Thus, for example, with a blend of hydroxypropyl methyl cellulose, carboxymethyl cellulose and poly(ethylene oxide), or other blends there can be selected from about 90 percent by weight to about 15 percent by weight of hydroxypropyl methyl cellulose, about 5 percent by weight to about 40 percent by weight of carboxymethyl cellulose and about 2 percent by weight to about 20 percent by weight of poly(ethylene oxide), from about 2 to about 20 percent by weight of diethylene glycol, and from about 1 to about 5 percent by weight of colloidal silica.

Illustrative examples of preferred coatings selected for the ink jet transparencies of the present invention include hydroxypropyl methyl cellulose (Methocel K35 LV and K4M available from Dow Chemical), 90 percent by weight, ethylene glycol plasticizer (available from Aldrich Chemical Company), 8 percent by weight, and colloidal silica available as Syloid 74 from W. R. Grace Company, 2 percent by weight; carboxymethyl cellulose (CMC 7HOF, available from Hercules Chemical Company), 90 percent by weight, ethylene carbonate (available from Aldrich Chemical Company), 8 percent by weight, and colloidal silica, 2 percent by weight; poly(acrylamide) (Scientific Polymer Products), 90 percent by weight, glycerol monostearate (Scientific Polymer Products), 8 percent by weight, and colloidal silica, 2 percent by weight; blends of hydroxyethyl cellulose (Natrosol 250LR, Hercules Chemical Company), 90 percent by weight, propylene glycol (Aldrich Chemical Company), 8 percent by weight, and colloidal silica, 2 percent by weight; blends of methyl cellulose (Methocel A4M, A15C, A4C, Dow Chemical Company), 90 percent by weight, propylene glycol monostearate (Scientific Polymer Products), 8 percent by weight, and colloidal silica, 2 percent by weight; blends of carboxymethyl hydroxyethyl cellulose (CMHEC 43H, 37L, Hercules Chemical Company), 90 percent by weight, diethylene glycol (Aldrich Chemical Company), 8 percent by weight and colloidal silica, 2 percent by weight; blends of carboxymethyl cellulose (7H3SX, Hercules Chemical Company), 85 percent by weight, poly(ethylene oxide) (Poly OX WSRN-3000, Union Carbide), 10 percent by weight, propylene carbonate (Aldrich Chemical Company), 4 percent by weight, and colloidal silica, 1 percent by weight; blends of hydroxypropylmethyl cellulose (Methocel K35LV), 85 percent by weight, poly(ethylene oxide) (Poly OX WSRN-3000), 10 percent by weight, tetramethylene sulfone (Aldrich Chemical Company), 4 percent by weight and colloidal silica, 1 percent by weight; blends of hydroxyethyl cellulose (Natrosol 250LR), 85 percent by weight, poly(ethylene oxide) (POLY OX WSRN-3000), 10 percent by weight, ethylene glycol (Aldrich Chemical Company), 4 percent by weight, and colloidal silica, 1 percent by weight; blends of poly(acrylamide) (Scientific Polymer Products), 40 percent by weight, methyl cellulose (Methocel A15C), 55 percent by weight, n-vinyl-2-pyrrolidinone (Aldrich Chemical Company), 4 percent by weight, and colloidal silica, 1 percent by weight; blends of carboxymethyl cellulose (CMC 7H3SX), 60 percent by weight, poly(acrylamide) (Scientific Polymer Products), 35 percent by weight, urea phosphate (Aldrich Chemical Company), 4 percent by weight, and colloidal silica, 1 percent by weight; blends of carboxymethyl cellulose (CMC 7H3SX), 80 percent by weight, poly(ethylene oxide) (WSRN-3000), 10 percent by weight, hydroxypropyl cellulose (Klucel Type E, Hercules Chemical Company), 5 percent by weight, glycerol alpha-monomethyl ether (Scientific Polymer Products), 4 percent by weight and colloidal silica, 1 percent by weight; blends of carboxymethyl cellulose (CMC 7H3SX), 10 percent by weight, hydroxyethyl cellulose (Natrosol 250LR), 75 percent by weight, poly(ethylene oxide), 10 percent by weight, n-methyl-2-pyrrolidinone (Aldrich Chemical Company), 4 percent by weight, and colloidal silica, 1 percent by weight; blends of carboxymethyl cellulose (CMC 7H3SX), 80 percent by weight, vinyl methyl ether/maleic acid copolymer (Gantrez S-95 GAF Corporation), 5 percent by weight, poly(ethylene oxide) (POLY OX WSRN-3000), 10 percent by weight, triphenyl phosphate (Aldrich Chemical Company), 4 percent by weight, and colloidal silica, 1 percent by weight; blends of acrylamide/acrylic acid copolymer (Scientific Polymer Products), 75 percent by weight, carboxymethyl cellulose (CMC 7H3SX), 10 percent by weight, poly(ethylene oxide) (POLY OX WSRN-3000), 10 percent by weight, bromophthalic anhydride (Aldrich Chemical Company), 4 percent by weight and colloidal silica, 1 percent by weight; blends of cellulose sulfate (Scientific Polymer Product), 75 percent by weight, carboxymethyl cellulose (CMC 7H3SX), 10 percent by weight, poly(ethylene oxide) (POLY OX WSRN-3000), 10 percent by weight, propylene glycol (Aldrich Chemical Company), 4 percent by weight, and colloidal silica, 1 percent by weight; blends of carboxymethyl cellulose (CMC 7H3SX), 80 percent by weight, poly(2-acrylamido-2-methyl propane sulfonic acid) (Scientific Polymer Products), 5 percent by weight, poly(ethylene oxide) (POLY OX WSRN-3000), 10 percent by weight, tetra chlorophthalic anhydride, 4 percent by weight, and colloidal silica, 1 percent by weight; blends of carboxymethyl cellulose (CMC 7H3SX), 80 percent by weight, poly(vinyl pyrrolidone) (GAF Corporation), 5 percent by weight, poly(ethylene oxide) (POLY OX WSRN-3000), 10 percent by weight, n-vinyl-2-pyrrolidinone (Aldrich Chemical Company), 4 percent by weight, and colloidal silica, 1 percent by weight; blends of carboxymethyl cellulose (CMC 7H3SX), 80 percent by weight, poly(vinyl alcohol) (Elvanol, DuPont Company), 5 percent by weight, poly(ethylene oxide) (POLY OX WSRN-3000), 10 percent by weight, glycerol monochlorohydrin (Scientific Polymer Product), 4 percent by weight and colloidal silica, 1 percent by weight; blends of carboxymethyl hydroxyethyl cellulose (CMHEC 37L, Hercules Chemical Company), 75 percent by weight, carboxymethyl cellulose (CMC 7H3SX), 10 percent by weight, poly(ethylene oxide) (POLY OX WSRN-3000), 10 percent by weight, propylene glycol (Aldrich Chemical Company), 4 percent by weight, and colloidal silica, 1 percent by weight; and blends of hydroxypropylmethyl cellulose (Methocel K35LV), 75 percent by weight, carboxymethyl cellulose (CMC 7H3SX), 10 percent by weight, poly(ethylene oxide) (POLY OX WSRN-3000), 10 percent by weight, diethylene glycol (Aldrich Chemical Company), 4 percent by weight, and colloidal silica, 1 percent by weight.

Specific coatings selected for the ink jet paper of the present invention, which coatings contain therein plasticizer(s) and filler(s), include blends of hydroxypropyl cellulose (Klucel Type E), 25 percent by weight, carboxymethyl cellulose (CMC 7H3SX), 15 percent by weight, poly(ethylene oxide) (POLY OX WSRN-3000), 10 percent by weight, ethylene carbonate (Aldrich Chemical Company), 10 percent by weight, and colloidal silica, 40 percent by weight; and blends of hydroxypropyl cellulose (Klucel Type E), 40 percent by weight, carboxymethyl cellulose, 25 percent by weight, poly(ethylene oxide) (POLY OX WSRN-3000), 10 percent by weight, propylene carbonate (Aldrich Chemical Company), 5 percent by weight, and titanium dioxide, 20 percent by weight.

The aforementioned blend polymer coatings with plasticizer and optional filler can be present on the supporting substrates, such as Mylar, or paper including diazo paper, unsized paper, and the like in various thicknesses depending on the coatings selected and the other components utilized; however, generally the total thickness on each side, that is the top and bottom surfaces of the supporting substrates of the coatings usually including plasticizer in filler, is from about 5 to about 25 microns, and preferably from about 7 to about 15 microns. Other coating thicknesses can be selected, especially when the coating mixture is applied to both the top and bottom surface of the supporting substrate. Moreover, the coatings, or coating mixture with plasticizer and filler when selected can be applied by a number of known techniques including reverse roll, extrusion and dip coating processes. In dip coating, a web of material to be coated is transported below the surface of the coating material by a single roll in such a manner that the exposed site is saturated, followed by the removal of any excess by a blade, bar or squeeze rolls. With reverse roll coating, the premetered material is transferred from a steel applicator roll to the web material moving in the opposite direction on a backing roll. Metering is performed in the gap precision-ground chilled iron rolls. The metering roll is stationary or is rotating slowly in the opposite direction of the applicator roll. Also, in slot extrusion coating there is selected a flat die to apply the coating materials of the present invention with the die lips in close proximity to the web of material to be coated. Once the desired amount of coating has been applied to the web, the coating is dried at 50° to 70° C. in an air dryer.

In one specific process embodiment, the ink jet transparencies or papers of the present invention are prepared by providing a substrate such as Mylar in a thickness of from about 100 to about 125 microns; and applying to each side of the Mylar by dip coating processes, in a thickness of from about 7 to 12 microns, a polymer blend mixture comprised of 5 percent by weight of hydroxypropyl cellulose, 80 percent by weight of carboxymethyl cellulose, and 10 percent by weight of poly(ethylene oxide), 4 weight percent of the plasticizer glycerol α-monomethylether, and 1 percent by weight of colloidal silica. Coating is affected from a solution blend of water, for example, about 80 percent, and ethanol or other aliphatic alcohol, about 20 percent by weight, having incorporated therein the polymer blend mixture. Thereafter, the coating is air dried and the resulting transparency with a paper backing can be utilized in a printer, such as the Xerox Corporation 4020 TM printer. The coating blend can be present on each, top and bottom, surface of the supporting substrate.

Resistance to humidity is the capacity of a transparency to control the blooming and bleeding of printed images where blooming represents intra-diffusion of dyes and bleeding represents inter-diffusion of dyes. The blooming test is performed by printing a bold filled letter such as T on a transparency and placing the transparency in a constant environment chamber preset at desired humidity and temperature. The vertical and the horizontal spread of the dye in the letter T is monitored periodically under a microscope. Resistance to humidity limit is established when the dyes selected start to diffuse out of the letter T. The bleeding test is performed by printing a checker board square pattern of various different colors and measuring the inter-diffusion of colors as a function of humidity and temperature.

With the coatings of the present invention, there is enabled in addition to humidity resistance at relative humidities of, for example, from about 20 to about 80 percent, a prolongation of the shelf life of ink jet transparencies thereby permitting high optical density images subsequent to extended storage periods. Also, the coating, or coating blends of the present invention enable a homogeneous spread of dyes in the inks thereby permitting images of optical densities, for example, of 1.35 (magenta), 1.03 (cyan), 0.62 (yellow) and 1.05 (black) in the transmission mode. With many of the coated transparencies commercially available, such as T-120 available from Minnesota, Mining, and Manufacturing, the selected dye cannot be evenly spread causing bleeding and mottling, thus the resulting dried images usually are of a lower optical density such as, for example, 0.76 for magenta, 0.73 for cyan, 0.44 for yellow, and 0.78 for black.

The optical density measurements illustrated herein, including the working Examples, were obtained on a Pacific Spectrograph Color System. The system consists of two major components: an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters, and the entry of tristimulus values; and an alphanumeric keyboard for entry of product standard information.

The following examples are being supplied to further define specific embodiments of the present invention, it being noted that these examples are intended to illustrate and not limit the scope of the present invention. Parts and percentages are by weight unless otherwise indicated.

EXAMPLE I

There were prepared 10 coated transparency Mylar sheets of a thickness of 100 microns by affecting a dip coating of these sheets (10) into a coating blend of hydroxypropyl methyl cellulose, 90 percent by weight, ethylene glycol plasticizer, 8 percent by weight, and colloidal silica filler, 2 percent by weight, which blend was present in a concentration of 5 percent by weight in water. Subsequent to air drying and monitoring the difference in weight prior to and subsequent to coating, the coated sheets had present on each side 1 gram, 12 microns in thickness, of the aforementioned blend. These sheets were then fed individually into a Xerox Corporation 4020 TM color ink jet printer having incorporated therein four separate developer inks, commercially available from Sharp Inc., and believed to be comprised of water, 92 percent by weight, ethylene glycol, 5 percent by weight, and a magenta, cyan, yellow, and carbon black colorant, respectively, 3 percent by weight, and there were obtained images with average optical densities (that is the sum of the optical densities of the 10 sheets divided by 10) of 1.19 (magenta), 1.02 (cyan), 0.77 (yellow), and 1.12 (black). These printed transparencies were placed in constant humidity (RH) and constant temperature environment preset at 80 percent RH and 80° F. temperature for humidity resistance testing, and all 10 of them did not evidence blooming or bleeding for a period of 7 days.

EXAMPLE II

There were prepared 10 coated transparency Mylar sheets of a thickness of 100 microns by affecting a dip coating of these sheets into a coating mixture of carboxymethyl cellulose, 90 percent by weight, ethylene carbonate plasticizer, 8 percent by weight, and colloidal silica filler, 2 percent by weight, which mixture was present in a concentration of 3 percent by weight in water. Subsequent to air drying and monitoring the difference in weight prior to and subsequent to coating, the coated sheets had present on each side about 800 milligrams, 9 microns in thickness, of the mixture. These sheets were then fed individually into a Xerox Corporation 4020 TM color ink jet printer as detailed in Example I. There were obtained images with average optical densities of 1.05 (magenta), 1.05 (cyan), 0.75 (yellow), and 1.15 (black). The images for all 10 sheets were resistant to 80 percent RH and 80° F. temperature for a period of 7 days.

EXAMPLE III

There were prepared 10 coated transparency Mylar sheets of a thickness of 100 microns by affecting a dip coating of these sheets into a coating mixture of hydroxypropylmethyl cellulose, 85 percent by weight, poly(ethylene oxide), 10 percent by weight, tetramethylene sulfone plasticizer, 4 percent by weight, and colloidal silica filler, 1 percent by weight, which mixture was present in a concentration of 5 percent by weight in water. Subsequent to air drying and monitoring the difference in weight prior to and subsequent to coating, the coated sheets had present on each side about 1 gram, 12 microns in thickness, of the mixture. These sheets were then fed individually into a Xerox Corporation 4020 TM color ink jet printer as detailed in Example I. There were obtained images with average optical densities of 1.15 (magenta), 0.95 (cyan), 0.75 (yellow) and 1.10 (black). These images for all 10 sheets were resistant to 80 percent RH and 80° F. temperature for a period of five days.

EXAMPLE IV

There were prepared 10 coated transparency Mylar sheets of a thickness of 100 microns by affecting a dip coating of these sheets into a coating mixture of hydroxypropylmethyl cellulose, 75 percent by weight, carboxymethyl cellulose, 10 percent by weight, poly(ethylene oxide), 10 percent by weight, diethylene glycol plasticizer, 4 percent by weight, and colloidal silica filler, 1 percent by weight, which blend was present in a concentration of 4 percent by weight in water. Subsequent to air drying and monitoring the difference in weight prior to and subsequent to coating, the coated sheets had present on each side about 1 gram, 12 micron in thickness, of the coating mixture. These sheets were then fed individually into a Xerox Corporation 4020 TM color ink jet printer as detailed in Example I. There were obtained images with average optical densities of 1.15 (magenta), 1.01 (cyan), 0.77 (yellow) and 1.12 (black). These images for all 10 sheets were resistant to humidity for a period of five days.

EXAMPLE V

There was prepared a coated ink jet paper by applying a coating to a roll of 90 micron thick Diazo paper on a Faustel Coater using reverse roll processes. The constituents of the coating were comprised of hydroxypropyl cellulose, 25 percent by weight, carboxymethyl cellulose, 15 percent by weight, poly(ethylene oxide), 10 percent by weight, ethylene carbonate plasticizer, 10 percent by weight, and colloidal silica filler, 40 percent by weight, which coating mixture was present in 15 percent by weight in water (25 percent) and methanol (75 percent) mixture. Subsequent to air drying and monitoring the difference in weight prior to and subsequent to coating, the coated ink jet paper had present 5 grams per meter squared of the coating mixture, 13 microns thick on each side of the sheet. These sheets were then fed individually into a Xerox Corporation 4020 TM color ink jet printer by repeating the procedure of Example I and images were obtained with average optical densities of 1.43 (black), 1.29 (magenta), 1.05 (cyan) and 1.05 (yellow). These images were resistant to humidity of 80 percent RH and 80° F. temperature for a period of 7 days.

EXAMPLE VI

There was prepared a coated plastic ink jet paper by affecting a dip coating of 75 microns thick Mylar sheets into a blend of hydroxy propyl cellulose, 40 percent by weight, carboxymethyl cellulose, 25 percent by weight, poly(ethylene oxide), 10 percent by weight, propylene carbonate plasticizer, 5 percent by weight, and titanium dioxide filler, 20 percent by weight, which blend was present in 10 percent by weight in water. Subsequent to air drying and monitoring the difference in weight prior to and subsequent to coating, the plastic paper had 5 grams per meter squared of the coating blend, 13 microns thick, on each side of the sheet. These sheets were then fed individually into a Xerox Corporation 4020 TM color ink jet printer by repeating the procedure of Example I and images with average optical densities of 1.98 (black), 2.00 (magenta), 1.50 (cyan) and 1.85 (yellow). The images were resistant to humidity of 80 percent RH and 80° F. temperature for a period of a week.

Other modifications of the present invention will occur to those skilled in the art based subsequent to a review of the present application. These modifications, as well as equivalents thereof, are intended to be included within the scope of this invention.

What is claimed is:

1. A humidity resistant ink jet transparency comprised of a supporting substrate and a hydrophilic coating comprised of from about 97 to about 75 percent by weight of a component selected from the group consisting of carboxymethyl cellulose, poly(acrylamide), hydroxyethyl cellulose, methyl cellulose, and carboxymethylhydroxyethyl cellulose, from about 2 to about 20 percent by weight of a plasticizer selected from the group consisting of propylene glycol, propylene glycol monostearate, diethylene glycol, and ethylene carbonate plasticizer, and from about 1 to about 5 percent by weight of colloidal silica filler.

2. A humidity resistant ink jet transparency comprised of a supporting substrate and a hydrophilic coating comprised of from about 95 to about 30 percent by weight of carboxymethyl cellulose, or hydroxy propyl methyl cellulose, from about 2 to about 45 percent by weight of poly(ethylene oxide), from about 2 to about 20 percent by weight of propylene carbonate and from about 1 to about 5 percent by weight of colloidal silica.

3. A humidity resistant ink jet transparency comprised of a supporting substrate and a hydrophilic coating comprised of from about 95 to about 30 percent by weight of hydroxyethyl cellulose, or methyl cellulose, from about 2 to about 45 percent by weight of poly(ethylene oxide), from about 2 to about 20 percent by weight of ethylene glycol, or vinyl pyrrolidone, and from about 1 to about 5 percent by weight of colloidal silica.

4. A humidity resistant ink jet transparency comprised of a supporting substrate and a hydrophilic coating comprised of from about 95 to about 30 percent by weight of carboxymethyl cellulose, from about 2 to about 45 percent by weight of poly(acrylamide), from about 2 to about 20 percent by weight of urea phosphate, and from 1 to about 5 percent by weight of colloidal silica.

5. A transparency comprised of a supporting substrate and a hydrophilic coating comprised of from about 2 to about 20 percent by weight of hydroxypropyl cellulose, from about 90 by about 30 percent by weight of carboxymethyl cellulose, from about 5 to about 25 percent by weight of poly(ethylene oxide), from about 2 to about 20 percent by weight of glycerol α-monomethyl ether, and from about 1 to about 5 percent by weight of colloidal silica.

6. A transparency comprised of a supporting substrate and a coating comprised of from about 90 to about 10 percent by weight of hydroxyethyl cellulose, from about 5 to about 40 percent by weight of carboxymethyl cellulose, from about 2 to about 25 percent by weight of poly(ethylene oxide), from about 2 to about 20 percent by weight of n-methyl-2-pyrrolidinone, and from about 1 to about 5 percent by weight of colloidal silica.

7. A transparency comprised of a supporting substrate and a coating comprised of from about 90 to about 25 percent by weight of carboxymethyl cellulose, from about 5 to about 30 percent by weight of vinyl methyl ether/maleic acid copolymer, from about 2 to about 20 percent by weight of poly(ethylene oxide), from about 2 to about 20 percent by weight of triphenyl phosphate, and from about 1 to about 5 percent by weight of colloidal silica.

8. A transparency comprised of a supporting substrate and a coating comprised of from about 5 to about 45 percent by weight of carboxymethyl cellulose, from about 90 to about 10 percent by weight of acrylamide/acrylic acid copolymer, from about 2 to about 20 percent by weight of poly(ethylene oxide), from about 2 to about 20 percent by weight of bromophthalic anhydride, and from about 1 to about 5 percent by weight of colloidal silica.

9. A transparency comprised of a supporting substrate and a coating comprised of from about 5 to about 40 percent by weight of carboxymethyl cellulose, from about 90 to about 15 percent by weight of cellulose sulfate, from about 2 to about 20 percent by weight of poly(ethylene oxide), from about 2 to about 20 percent by weight of propylene glycol, and from about 1 to about 5 percent by weight of colloidal silica.

10. A transparency comprised of a supporting substrate and a hydrophilic coating comprised of from about 90 to about 25 percent by weight of carboxymethyl cellulose, from about 5 to about 30 percent by weight of poly(2-acrylamido-2-methylpropane sulfonic acid), from about 2 to about 20 percent by weight of poly(ethylene oxide), from about 2 to about 20 percent by weight of tetra chlorophthalic anhydride, and from about 1 to about 5 percent by weight of colloidal silica.

11. A transparency comprised of a supporting substrate and a hydrophilic coating comprised of from about 2 to about 20 percent by weight of poly(vinyl pyrrolidone), or polyvinyl alcohol, from about 90 to about 35 percent by weight of carboxymethyl cellulose, from about 5 to about 20 percent by weight of poly(ethylene oxide), from about 2 to about 20 percent by weight of n-vinyl-2-pyrrolidinone, or glycerol monohydrate, and from about 1 to about 5 percent by weight of colloidal silica.

12. A transparency comprised of a supporting substrate and a hydrophilic coating comprised of from about 90 to about 15 percent by weight of carboxy methyl hydroxyethyl cellulose, or hydroxy propyl methyl cellulose, from about 5 to about 40 percent by weight of carboxymethyl cellulose, from about 2 to about 20 percent by weight of poly(ethylene oxide), from about 2 to about 20 percent by weight of propylene glycol, or diethylene glycol, and from about 1 to about 5 percent by weight of colloidal silica.

13. An ink jet paper comprised of a supporting substrate and as a coating on the supporting substrate a mixture comprised of from about 10 to about 15 percent by weight of poly(ethylene oxide), from about 15 to about 5 percent by weight of carboxymethyl cellulose, from about 25 to about 3 percent by weight of hydroxypropyl cellulose, from about 20 to about 2 percent by weight of ethylene carbonate, and from 30 to about 75 percent by weight of colloidal silica.

* * * * *